US005288116A

United States Patent [19]

Donofrio

[11] Patent Number: 5,288,116

[45] Date of Patent: Feb. 22, 1994

[54] DOOR HANDLE ADAPTER AND METHOD

[75] Inventor: Philip J. Donofrio, Ansonia, Conn.

[73] Assignee: Leeverall, Inc., Ansonia, Conn.

[21] Appl. No.: 47,866

[22] Filed: Apr. 15, 1993

[51] Int. Cl.[5] ..... E05B 3/00

[52] U.S. Cl. ..... 292/336.3; 292/347; 292/173

[58] Field of Search ..... 292/347, 350, 336.3, 292/DIG. 2, 173; 29/437

[56] References Cited

U.S. PATENT DOCUMENTS

| | | | |
|---|---|---|---|
| 2,344,376 | 3/1944 | Stone | 292/350 |
| 2,742,314 | 4/1956 | Santos | 292/336.3 |
| 3,827,739 | 8/1974 | Overholser | 292/DIG. 2 |
| 4,018,465 | 4/1977 | Ramler | 292/336.3 |
| 4,223,931 | 9/1980 | Neary | 292/347 |
| 4,397,489 | 8/1983 | Lind | 292/347 |
| 4,504,087 | 3/1985 | Pennington | 292/347 |
| 4,648,463 | 3/1987 | Bettger | 292/347 |
| 4,655,059 | 4/1987 | Best et al. | 292/347 X |
| 4,783,883 | 11/1988 | Szalay | 292/347 |
| 4,913,479 | 4/1990 | Allison | 292/347 |
| 4,971,375 | 11/1990 | Grecco | 292/347 |
| 5,149,155 | 9/1992 | Caeti et al. | 292/336.3 |

*Primary Examiner*—Richard E. Moore
*Attorney, Agent, or Firm*—Bachman & LaPointe

[57] ABSTRACT

An adapter and method for retrofitting a round door knob with a lever attachment including a lever arm portion and a door knob receiving portion wherein the door knob receiving portion may be fitted to the door knob while the door knob remains in place on the door assembly. The door knob receiving portion of the lever attachment has first and second bores of different diameters which allows the door knob to be abuttingly received within the door knob receiving portion and fixed in place therein by securing elements which project through a plurality of bores provided in the door knob receiving portion of the lever attachment.

7 Claims, 3 Drawing Sheets

DOOR HANDLE ADAPTER AND METHOD

BACKGROUND OF THE INVENTION

The present invention is drawn to a method and apparatus for retrofitting a round or cylindrical shaped door knob with a lever type handle.

In the past numerous door knobs have been employed which require a person to grip the knob by hand and rotate the knob clockwise or counter-clockwise to operate the knob and lock mechanism. While the door knobs operate in an apparent simple and easy manner, in many cases handicapped persons may lack the ability to grip and rotate such a knob. Accordingly it has become desirable to replace or retrofit the cylindrical or ball shaped door knob with a lever type handle which is more easily actuated by all including the handicapped.

The prior art is replete with devices for adapting conventional door knobs to lever type handles. For example, U.S. Pat. No. 4,397,489 discloses an adapter for providing a lever attachment to a round door knob which has a hollow threaded cylinder fitted with a lever which cylinder slides over the knob and is frictionally secured to the knob by compressing the knob between one end of the cylinder and a tightened split ring threaded into the other end of the cylinder. Elastomeric material placed on either or both sides of the knob increase the friction and prevent slipping of the adapter on the knob after tightening. This adapter is extremely complex in structure due to its numerous parts. In addition, the door knob and shank must be disassembled from the door lock system in order to secure the device to the knob. Both of these disadvantages render the device unsuitable for commercial use. U.S. Pat. No. 4,223,931 discloses a device for converting a door knob to a lever operated door knob wherein the device comprises a mounting portion for mounting the operating lever to a doorknob; a lever secured to the mounting portion; the mounting portion being secured to the back face of a conventional door knob; and the mounting portion partially surrounding the stem of the doorknob. Again the door knob must be removed from the door unit to retrofit same. U.S. Pat. No. 4,648,643 discloses a multi-piece retrofit lever assembly which comprises a lever assembly of two principal parts: a lever with a circular aperture to engage the shank of a door knob, and a retaining plate, for fastening thereof to the lever, having a projecting cog. The cog engages a knob catch slot in the door knob shank. Accordingly, as the lever is rotated/manipulated, it turns the door knob through the engagement of the cog with the slot, and the fastening of the plate to the lever. The assembly accommodates retrofitting thereof to doors having round door knobs. Again, this assembly is complex in structure, expensive to produce and difficult to retrofit.

Naturally, it would be highly desirable to provide a retrofit device for converting a round door knob to a lever action door knob which is readily assembled onto a door knob in situ on the door.

Accordingly, it is the principle object of the present invention to provide a device for adapting a round door knob to a lever handle door knob which is of simple, economic construction and easily assembled to the round door knob without removing the door knob from the door.

It is a particular object of the present invention to provided a method for retrofitting a round door knob with a lever assembly which insures secure fit.

It is a still further object of the present invention to provide a lever handle door knob attachment which meets local fire code requirements and is aesthetically pleasing.

Further objects and advantages of the present invention will appear hereinbelow.

SUMMARY OF THE INVENTION

The present invention is drawn to a method and apparatus for retrofitting a round door knob with a lever type handle which is easily actuated by, particularly, handicapped individuals. As used in the instant specification and claims, the term "round" when referring to a door knob is meant to include all typical door knobs commercially available whether they be of the round, ball, tulip and/or oval type.

The device of the present invention for retrofitting round door knobs comprises a one piece, metal lever attachment having a lever arm portion and a door knob receiving portion. The door knob receiving portion is provided with a recess having a diameter substantially equal to that of the round door knob over which the cylindrical portion is to fit. The sidewall portion of the cylindrical portion of the metal lever attachment is provided with a plurality of bores which receive a securing mechanism which, upon assembly, project into the recess for securing the door knob to the metal lever attachment within the recess for rotational movement therewith. In order to insure a secure attachment of the metal lever attachment to the round door knob, the present invention includes a method for properly sizing the diameter of the recess portion of the metal lever attachment. The method comprises providing a sizing template having a plurality of circular openings of various diameters thereon and inserting the round door knob to be retrofitted into the openings of the templates so as to determine the maximum outside diameter of the knob. The cylindrical portion of the metal lever attachment is thereafter machined to a diameter substantially equal to the diameter of the knob so as to provide a tight fit of the handle to the knob upon assembly With the securing members in the bores provided in the sidewall of the cylindrical portion. The structure of the metal lever attachment of the present invention allows for the lever to be attached to the door knob in situ, that is, when the door knob is located on the door.

The retrofit device of the present invention for converting a round door knob to a lever action door knob is of simple construction, economic to manufacture, and easy to install. Further objects and advantages of the present invention will become more apparent by reference to the following detailed description taken in conjunction with the accompanying figures which are described hereinbelow.

DETAILED DESCRIPTION

Figure 1:
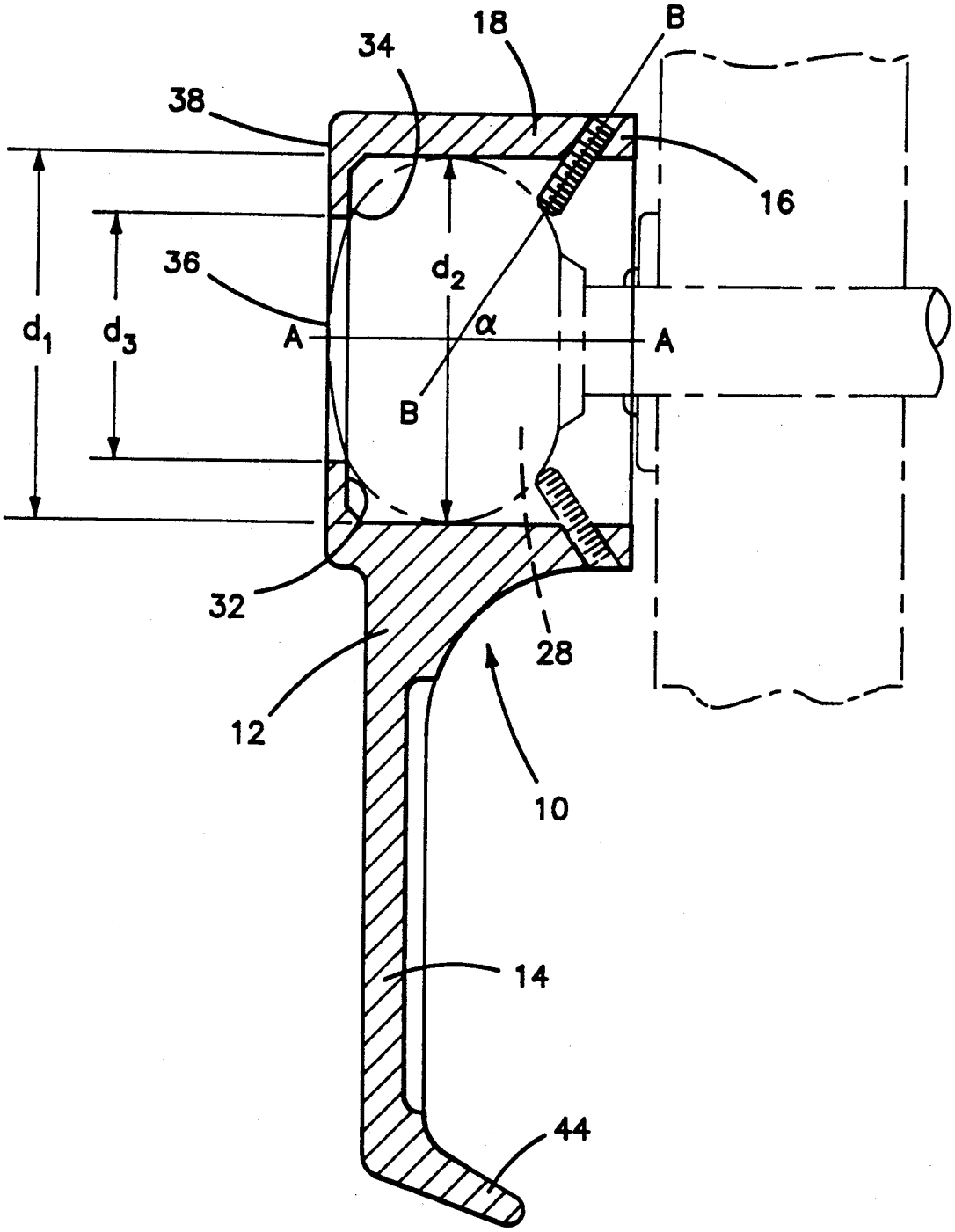
FIG. 1 is a partial sectional side view of an assembled door knob having a retrofit lever attachment according to the present invention installed thereon.
Figure 2:
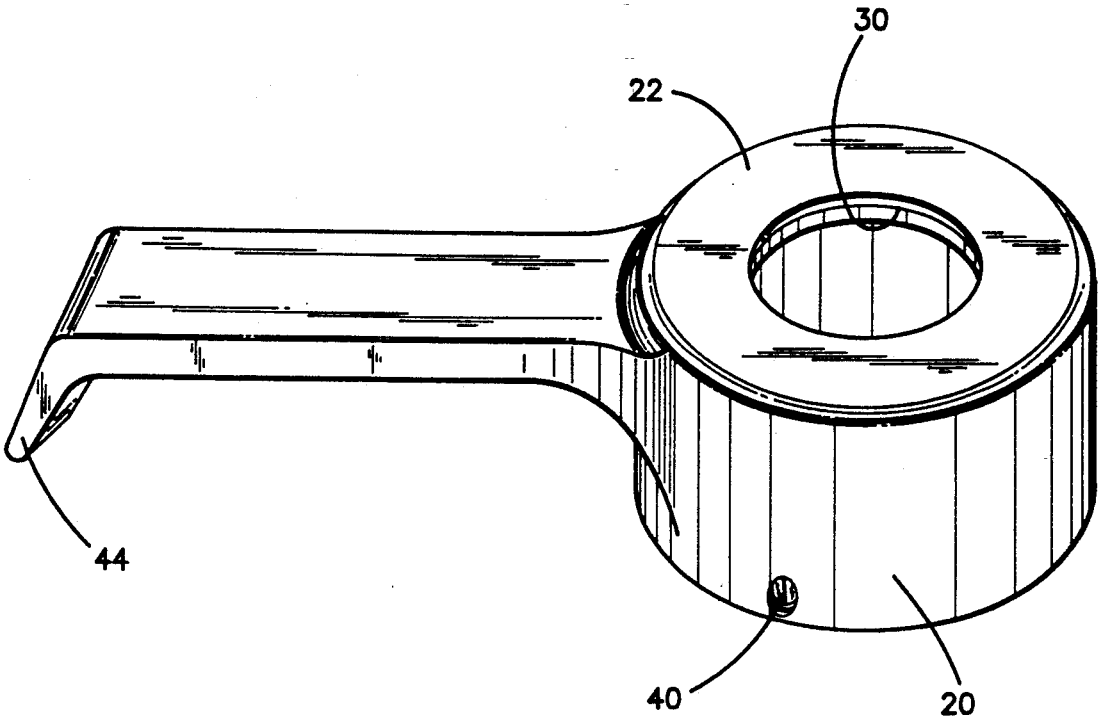
FIG. 2 is a top perspective view of the metal lever attachment of the present invention.
Figure 3:
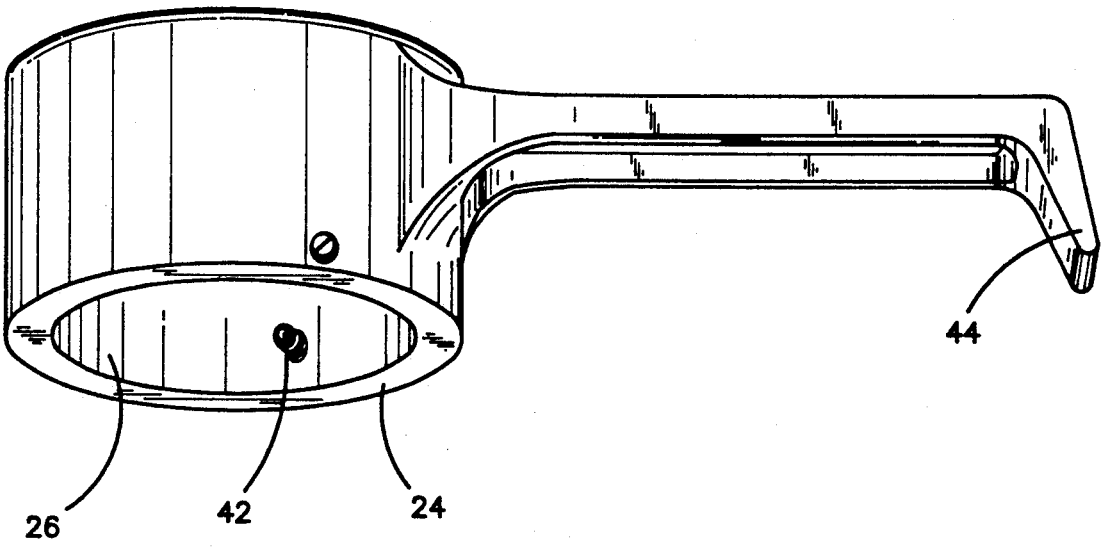
FIG. 3 is a bottom perspective view of the metal lever attachment of the present invention.

Referring to FIG. 1, there is illustrated a device for adapting a round door knob to a lever handle installed on a round type door knob.

The device 10 of the present invention for adapting a round door knob 28 to a lever handle comprises a one piece, metal lever attachment 12 having a lever arm portion 14 and a door knob receiving portion 16. It is required in accordance with the present invention that the lever attachment be made of metal in order to have sufficient structural integrity and fire resistance so as to meet standard fire codes. The door knob receiving portion 16 comprises a substantially cylindrical portion 18 extending about an axis A. The cylindrical portion 18 has an outer cylindrical sidewall portion 20, a top wall portion 22 and bottom wall portion 24.

In accordance with the present invention the cylindrical portion 18 is provided with a recess in the bottom wall portion 24 thereof which is adapted to receive the round door knob 28 in a manner to be described hereinbelow. The diameter $d_1$ of the circular recess 26 is formed so as to have a diameter substantially equal to the outermost diameter $d_2$ of the door knob 28. In addition, the depth of the recess preferably must be greater than the depth of the door knob.

The top wall portion 22 of the cylindrical portion 18 is provided with a circular bore 30 of diameter $d_3$ which communicates with the recess 26 so as to form a through passage therewith. The diameter $d_3$ of the circular bore 30 is less than the diameter $d_2$ and $d_1$ of the door knob and recess and together define a shoulder 32 which forms an abutment surface 34 which receives the end face 36 of the door knob 28. The diameter $d_3$ of the circular bore is selected so that the end face 36 of the door knob 28 lies substantially flush with the surface 38 of top wall portion 22. This arrangement allows for an aesthetically pleasing assembly a shoulder 32 is formed at the interface of circular bore 30 and recess 26 so as to define an abutment surface 34.

In accordance with a preferred feature of the present invention a plurality of bores are provided through the side wall portion 20 of the cylindrical portion 18. The number of bores 40, which should be at least 3, are radially disposed preferably equilaterally around the surface of the side wall portion 20. Thus, the bores are radially disposed about the axis A and extend along an axis B which intersects a plane which extends parallel to and passes through the axis A. In its most preferred embodiment, the axis B of the bores intersect the axis A and forms therewith an angle $\alpha$ which is greater than of equal to about degrees. In accordance with the present invention each of the bores 40 are threaded and are each provided with a securing element 42 which is movably received within the bores 40. In the embodiment shown FIG. 1, the bores 42 are threaded and the securing elements 42 are likewise threaded and received within the threaded bores. Thus, the securing elements 42 are movable within each of the bores 40 along the axis B for securing the door knob within the recess 26 against the abutment surface 34 formed by shoulder 32 in the manner shown in FIG. 1.

From FIG. 1 it can be seen that the securing elements 42 not only lock the metal lever attachment 12 to the door knob, but bias the abutment surface 34 of the lever attachment against the end face 36 of the door knob 28 for further holding the lever attachment in place on the door knob 28.

The lever arm portion 14 of the metal lever attachment 12 is provided with a flared end 44 which acts as a stop so as to assist in prohibiting one's hand from slipping off of the lever arm portion when manipulating the lever.

Figure 4:
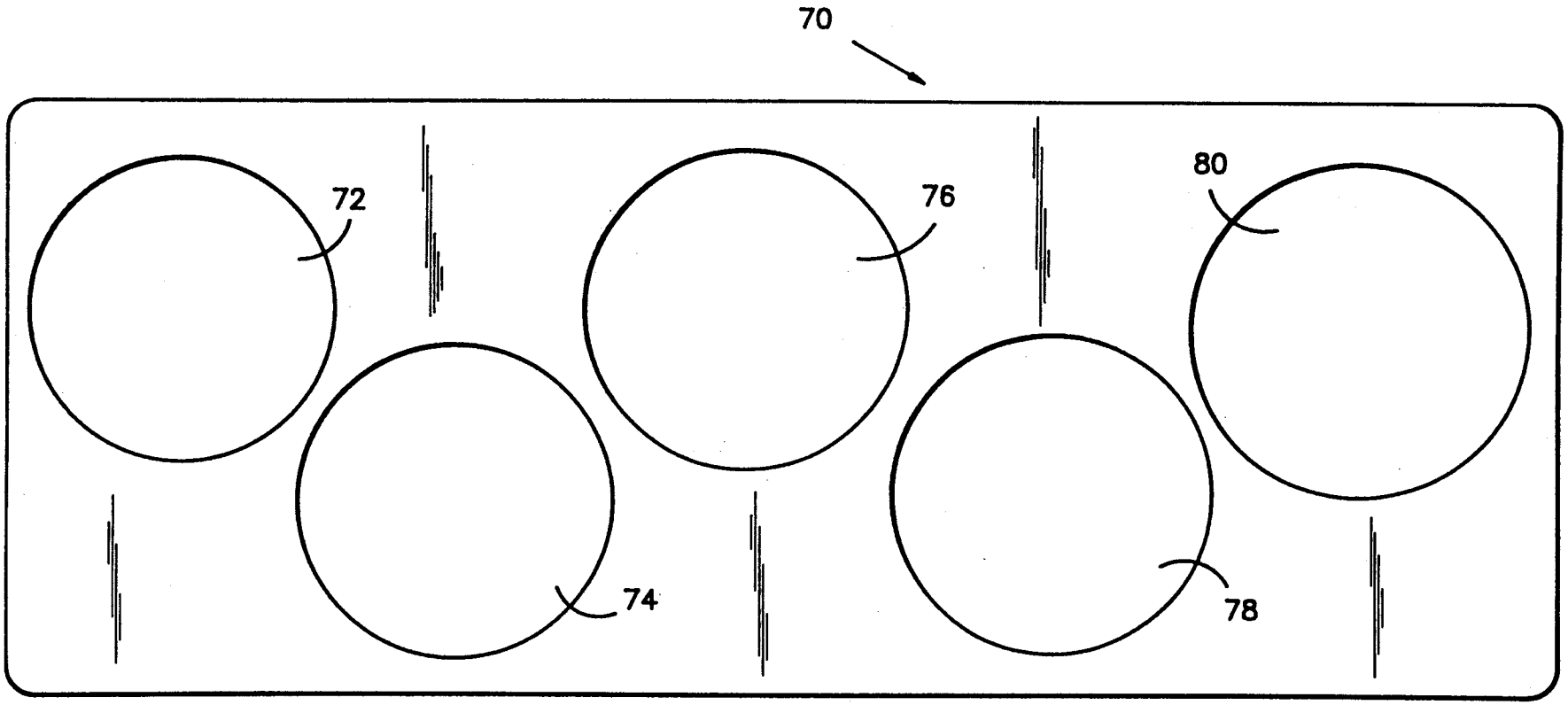
FIG. 4 is a plane view of the template used in the method for retrofitting a round door knob in accordance with the present invention.

One of the advantageous features of the lever attachment of the present invention is the fact that a round door knob can be readily retrofitted with the lever attachment while the door knob remains in situ on the door. The method for retrofitting includes providing a sizing template 70 shown in FIG. 4 which has a plurality of circular openings 72, 74, 76, 78 and 80 of various diameter ranging from 2 to 2¼ inches at 1/16 inch intervals. the template 40 may be made larger or a second template employed having circular openings up to 2½ inches. If desired, separate individual templates may be made for each diameter size. The method comprises inserting the door knob 28 to be retrofitted successively into the openings 72–80 in the template 70 so as to determine the maximum outside diameter $d_2$ of the round door knob 28. Once the diameter $d_2$ has been determined a blank of the metal lever attachment which has been previously cast is machined with the recess 26 so that the diameter $d_1$ of the recess is substantially equal to the diameter $d_2$ of the door knob. The radially disposed bores 40 are thereafter tapped into the side wall 20 of the cylindrical portion 18 such that the bores radiate along the axes B which intersect a plane which extends parallel to and passes through axis A. The cylindrical portion 18 is thereafter placed over the door knob such that the door knob is received within the recess 26 and abuts the abutment surface 34 formed by the top wall 22 of the cylindrical portion 18 and secured in place therein by the securing elements 42.

It can be seen from the foregoing that the method and device of the present invention allows for readily retrofitting existing round door knob in an efficient and economic manner which the door knob remains in situ, that is, assembled on the door.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for adapting a round door knob to a lever handle door knob comprising a one piece, metal lever attachment having a lever arm portion and a door knob receiving portion, said door knob receiving portion comprises a substantially cylindrical portion extending along an axis A, said cylindrical portion having a sidewall portion, a top wall portion and a bottom wall portion; a substantially circular recess having a diameter $d_1$ provided in said bottom wall portion and extending toward said top wall portion and defining therewith an abutment surface for receiving a door knob having a maximum outside diameter $d_2$ wherein $d_2$ and $d_1$ are substantially equal; a plurality of bore means provided in said sidewall and radially disposed about axis A, each of said bore means extending along an axis B which intersects a plane which extends parallel to and passes through axis A; and securing means movable with each bore means along axis B for securing the door knob within said recess against said abutment surface.

2. A device according to claim 1 wherein the top wall portion is provided with a circular bore of diameter $d_3$ which communicates with said recess wherein $d_3$ is less than $d_1$ such that only a portion of said door knob is received within said bore.

3. A device according to claim 2 wherein said portion of said door knob lies flush with said top wall portion with said circular bore.

4. A method for retrofitting a round door knob with a lever handle so as to allow use by disabled persons comprising the steps of:

providing a sizing template means having a plurality of circular openings of various diameters ranging between 2.00 to 2.25 inch at 0.0675 inch intervals;

inserting a round door knob to be retrofit successively into said openings in said template means so as to determine the maximum outside diameter $d_2$ of said knob;

providing a metal lever handle having a lever arm portion and a door knob receiving portion comprising a cylindrical portion extending along an axis A, said cylindrical portion having a sidewall portion, a top wall portion and a bottom wall portion;

machining a recess of diameter $d_1$ in said bottom wall portion wherein $d_1$ and $d_2$ are substantially equal and wherein said recess defines with said top wall portion an abutment surface;

providing a plurality of bores in said sidewall radially disposed about said axis A wherein each of said bores radiate along an axis B which intersects a plane which extends parallel to and passes through axis A;

inserting said round door knob within said recess so that said door knob abuts said abutment surface; and inserting securing means in said bores for securing said metal lever handle to said round door knob.

5. A method according to claim 4 including machining a circular bore in said top wall portion of diameter $d_3$ which communicates with said recess wherein $d_3$ is less than $d_1$ such that only a portion of said door knob is received within said bore.

6. A method according to claim 5 wherein said portion of said door knob lies flush with said top wall portion with said circular bore.

7. A system for assisting in opening a door comprising: a door; a round door knob having a shank portion extending from said door knob through said door; a one piece, metal lever attachment having a lever arm portion and a door knob receiving portion, said door knob receiving portion comprises a substantially cylindrical portion extending along an axis A, said cylindrical portion having a sidewall portion, a top wall portion and a bottom wall portion; a substantially circular recess having a diameter $d_1$ provided in said bottom wall portion and extending toward said top wall portion and defining therewith an abutment surface for receiving a door knob having a maximum outside diameter $d_2$ wherein $d_2$ and $d_1$ are substantially equal; a plurality of bore means provided in said sidewall and radially disposed about axis A, each of said bore means extending along an axis B which intersects a plane which extends parallel to and passes through axis A; and securing means movable with each bore means along axis B for securing the door knob within said recess against said abutment surface.

* * * * *